US005529415A

United States Patent [19]

Bishop

[11] Patent Number: 5,529,415

[45] Date of Patent: Jun. 25, 1996

[54] FINGERTIP PEN WRITER

[76] Inventor: Deborah L. Bishop, 26910 River Bridge Rd., Henderson, Md. 21640

[21] Appl. No.: 413,002

[22] Filed: Mar. 29, 1995

[51] Int. Cl.[6] ..... B43K 7/00

[52] U.S. Cl. ..... 401/7; 401/8

[58] Field of Search ..... 401/7, 8

[56] References Cited

U.S. PATENT DOCUMENTS

| | | | |
|---|---|---|---|
| 684,685 | 10/1901 | Gerst | 401/7 |
| 2,509,837 | 5/1950 | Niizawa | 401/7 |
| 3,887,286 | 6/1975 | Bucey | 401/7 |
| 4,149,661 | 4/1979 | Curtiss | 223/101 |

FOREIGN PATENT DOCUMENTS

| | | | |
|---|---|---|---|
| 2636886 | 3/1990 | France | 401/7 |
| 2161021 | 6/1973 | Germany | 401/7 |
| 8500322 | 9/1986 | Netherlands | 401/7 |
| 2061832 | 5/1981 | United Kingdom | 401/7 |

*Primary Examiner*—Steven A. Bratlie

[57] ABSTRACT

A fingertip pen writer comprised of a finger portion adapted for removable securement to a fingertip of a user. The finger portion has a holding chamber formed in an upper portion thereof. The finger portion has a ball point pen tip secured to an open end portion outwardly extending therefrom. An ink supply tube is secured within the holding chamber of the finger portion. The ink supply tube couples with the ball point pen tip of the finger portion for supplying ink to the ball point pen tip.

1 Claim, 3 Drawing Sheets

FINGERTIP PEN WRITER

BACKGROUND OF THE INVENTION

1. Field of the Invention

The present invention relates to a fingertip pen writer and more particularly pertains to attaching a writing implement to a user's finger with a fingertip pen writer.

2. Description of the Prior Art

The use of finger pens is known in the prior art. More specifically, finger pens heretofore devised and utilized for the purpose of writing on paper are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,314,260 to Andersson discloses a finger pen.

U.S. Pat. No. 4,986,682 to Lu discloses a retractable finger pen.

U.S. Pat. No. 4,738,556 to Brown discloses a finger pen.

U.S. Pat. No. Des. 253,416 to Macintosh discloses the ornamental design for a finger ballpoint pen.

U.S. Pat. No. Des. 246,904 to Macintosh discloses the ornamental design for a finger ballpoint pen.

U.S. Pat. No. 3,947,132 to Fox discloses a finger tip writing instrument.

While these devices fulfill their respective, particular objective and requirements, the aforementioned patents do not describe a fingertip pen writer for attaching a writing implement to a user's finger.

In this respect, the fingertip pen writer according to the present invention substantially departs from the conventional concepts and designs of the prior art, and in doing so provides an apparatus primarily developed for the purpose of attaching a writing implement to a user's finger.

Therefore, it can be appreciated that there exists a continuing need for new and improved fingertip pen writer which can be used for attaching a writing implement to a user's finger. In this regard, the present invention substantially fulfills this need.

SUMMARY OF THE INVENTION

In the view of the foregoing disadvantages inherent in the known types of finger pens now present in the prior art, the present invention provides an improved fingertip pen writer. As such, the general purpose of the present invention, which will be described subsequently in greater detail, is to provide a new and improved fingertip pen writer and method which has all the advantages of the prior art and none of the disadvantages.

To attain this, the present invention essentially comprises a finger portion having a rounded first end and an open second end. The open second end is adapted for removable securement to a fingertip of a user. The finger portion has a holding chamber formed in an upper portion thereof. The holding chamber has an open end portion extending outwardly of the rounded first end of the finger portion. The finger portion has a ball point pen tip secured to the open end portion outwardly extending of the rounded first end. An ink supply tube is secured within the holding chamber of the finger portion. The ink supply tube couples with the ball point pen tip of the finger portion for supplying ink to the ball point pen tip. A protective cap is adapted for securement over the ball point pen tip of the finger portion to prevent ink from dispelling out of the ball point pen tip. The device contains a flexible adapter ring having an open first end, an open second end, and an intermediate extent therebetween. The intermediate extent has a slot formed therein extending from the open first end to the open second end. The flexible adapter ring removably secures to a user's finger to provide a tighter fit when the finger portion is secured on the user's finger.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved fingertip pen writer which has all the advantages of the prior art finger pens and none of the disadvantages.

It is another object of the present invention to provide a new and improved fingertip pen writer which may be easily and efficiently manufactured and marketed.

It is a further object of the present invention to provide a new and improved fingertip pen writer which is of durable and reliable construction.

An even further object of the present invention is to provide a new and improved fingertip pen writer which is susceptible of a low cost of manufacture with regard to both materials and labor, and which accordingly is then susceptible of low prices of sale to the consuming public, thereby making such a fingertip pen writer economically available to the buying public.

Still yet another object of the present invention is to provide a new and improved fingertip pen writer which provides in the apparatuses and methods of the prior art some of the advantages thereof, while simultaneously overcoming some of the disadvantages normally associated therewith.

Even still another object of the present invention is to provide a new and improved fingertip pen writer for attaching a writing implement to a user's finger.

Lastly, it is an object of the present invention to provide a new and improved fingertip pen writer comprised of a finger portion adapted for removable securement to a fingertip of a user. The finger portion has a holding chamber formed in an upper portion thereof. The finger portion has a ball point pen tip secured to an open end portion outwardly extending therefrom. An ink supply tube is secured within the holding chamber of the finger portion. The ink supply tube couples with the ball point pen tip of the finger portion for supplying ink to the ball point pen tip.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
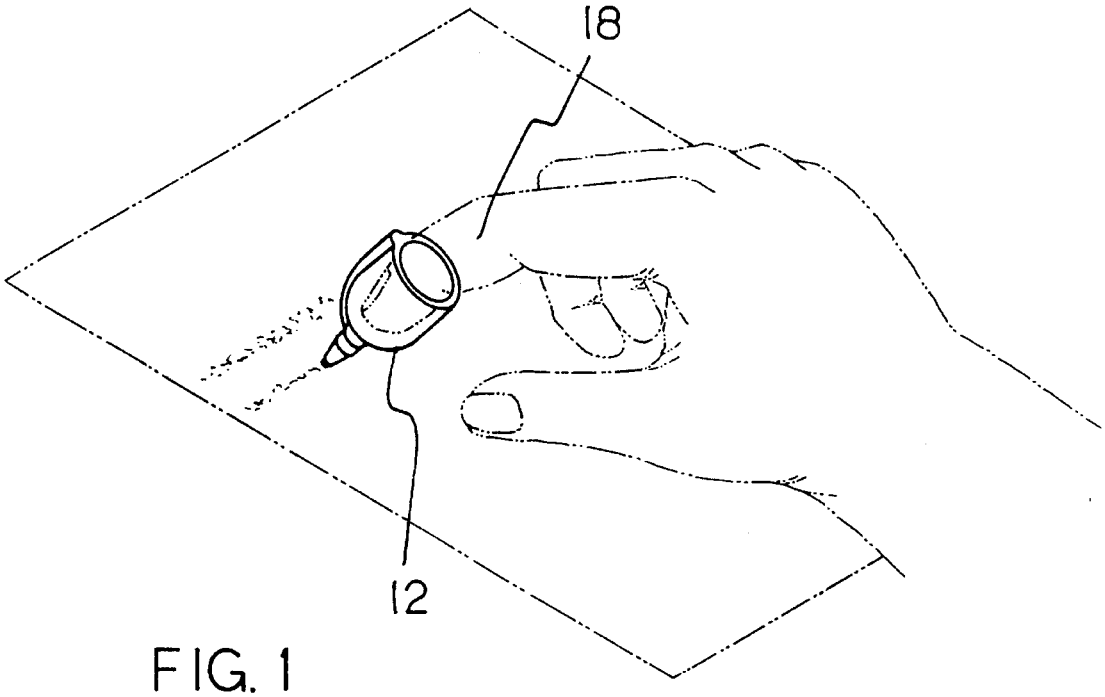
FIG. 1 is a perspective view of the preferred embodiment of the fingertip pen writer constructed in accordance with the principles of the present invention.
Figure 2:
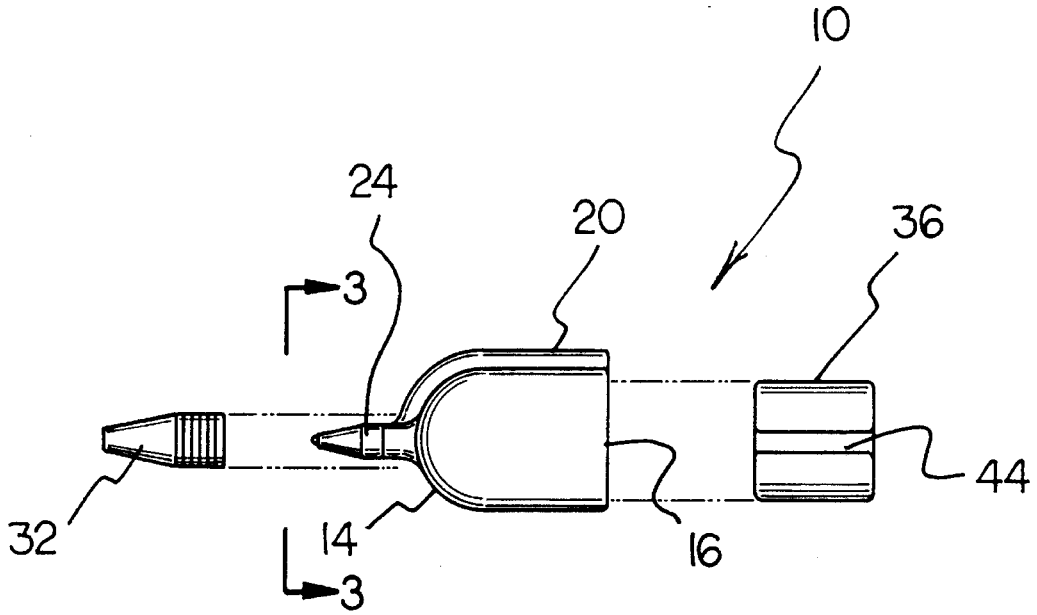
FIG. 2 is a side elevation view of the present invention.
Figure 3:
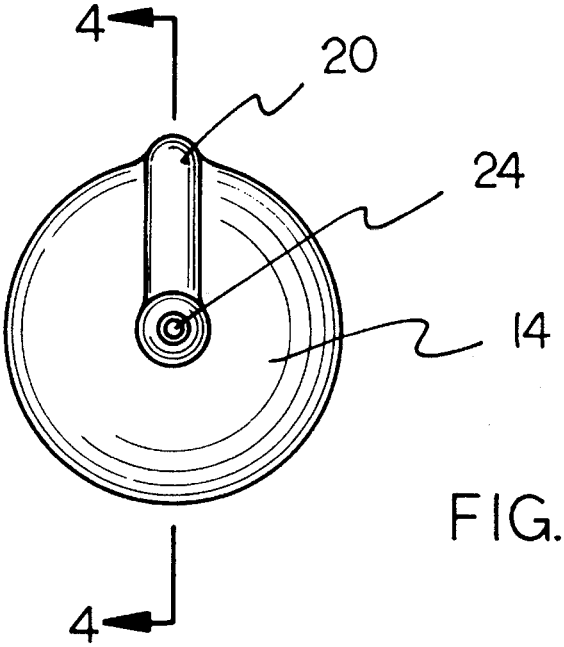
FIG. 3 is a front elevation view of the present invention.
Figure 4:
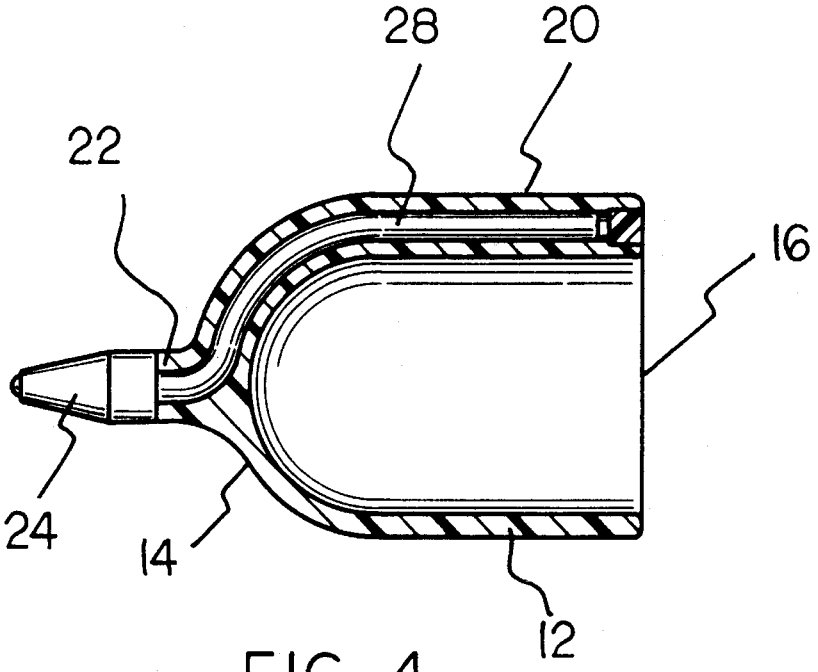
FIG. 4 is a cross-sectional view as taken along line 4—4 of FIG. 3.
Figure 5:
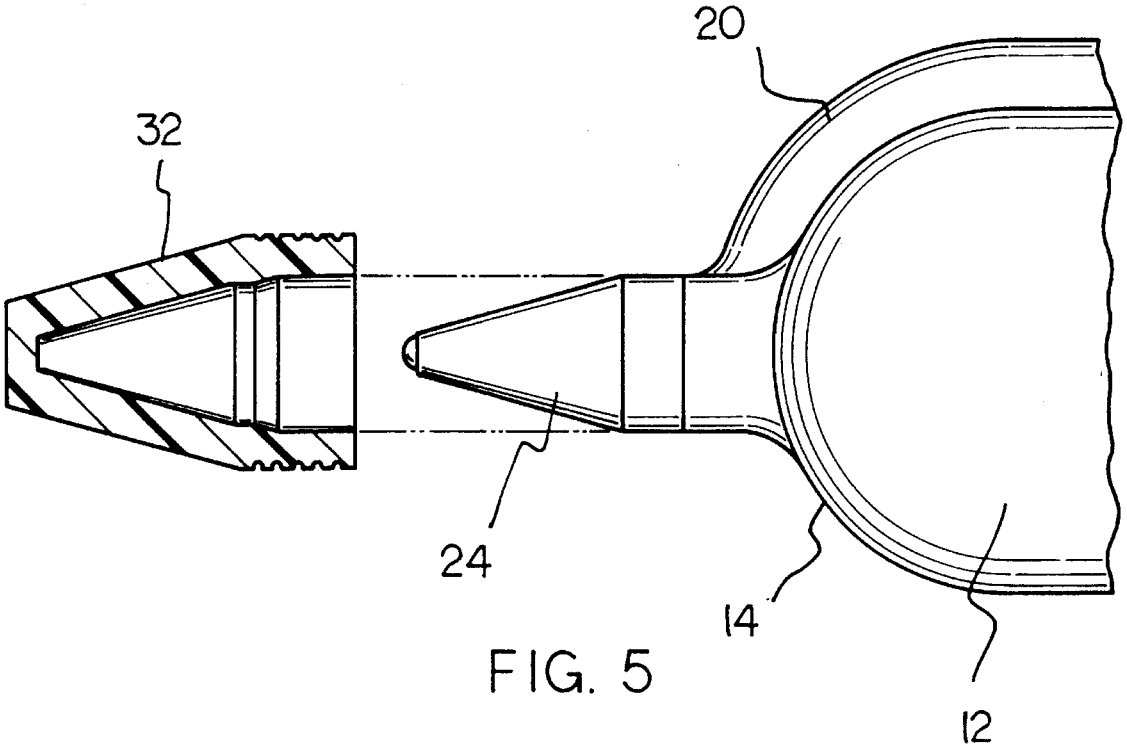
FIG. 5 is an enlarged side view of the removable cap of the present invention.
Figure 6:
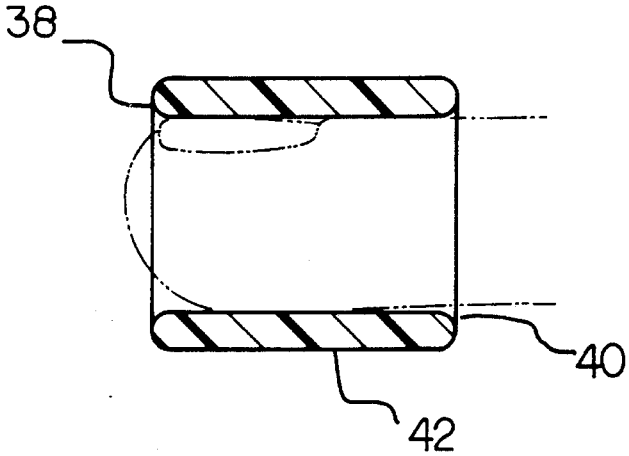
FIG. 6 is a side view of the adapter ring of the present invention.

With reference now to the drawings, and in particular, to FIG. 1–6 thereof, the preferred embodiment of the new and improved fingertip pen writer embodying the principles and concepts of the present invention and generally designated by the reference number 10 will be described.

Specifically, it will be noted in the various Figures that the device relates to a new and improved fingertip pen writer for attaching a writing implement to a user's finger. In its broadest context, the device consists of a finger portion, an ink supply tube, a protective cap, and a flexible adapter ring.

The device 10 contains a finger portion 12 having a rounded first end 14 and an open second end 16. The open second end 16 is adapted for removable securement to a fingertip 18 of a user. The finger portion 12 has a holding chamber 20 formed in an upper portion thereof. The holding chamber 20 has an open end portion 22 extending outwardly of the rounded first end 14 of the finger portion 12. The finger portion 12 has a ball point pen tip 24 secured to the open end portion 22 outwardly extending of the rounded first end 14. The ball point pen tip 24 is positioned directly below the fingertip 18 thereby allowing pressure to be controlled and applied to a writing surface. The finger portion 12 allowing the user of the device 10 to pursue his/her activities without interruptions necessitated by picking up and setting down a writing instrument each time it is needed.

An ink supply tube 28 is secured within the holding chamber 20 of the finger portion 12. The ink supply tube 20 couples with the ball point pen tip 24 of the finger portion 12 for supplying ink to the ball point pen tip 24. The ink supply tube 28 can be supplied with differing colors of ink to suit the preferences of the user.

A protective cap 32 is adapted for securement over the ball point pen tip 24 of the finger portion 12 to prevent ink from dispelling out of the ball point pen tip 24. The protective cap 32 is generally conical in shape and merely snaps in place over the ball point pen tip 24.

The device 10 contains a flexible adapter ring 36 having an open first end 38, an open second end 40, and an intermediate extent 42 therebetween. The intermediate extent 42 has a slot 44 formed therein extending from the open first end 38 to the open second end 40. The flexible adapter ring 36 removably secures to a user's finger to provide a tighter fit when the finger portion 12 is secured on the user's finger. The slot 44 allows the flexible adapter ring 36 to expand slightly to conform to the user's finger. The flexible adapter ring 36 allows the user having a smaller finger to allow the finger portion 12 to be secured onto their finger.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A fingertip pen writer for attaching a writing implement to a user's finger comprising, in combination:

a finger portion having a rounded first end and an open second end, the open second end being adapted for removable securement to a fingertip of a user, the finger portion having a holding chamber formed in an upper portion thereof, the holding chamber having an open end portion extending outwardly of the rounded first end of the finger portion, the finger portion having a ball point pen tip secured to the open end portion outwardly extending of the rounded first end;

an ink supply tube secured within the holding chamber of the finger portion, the ink supply tube coupling with the ball point pen tip of the finger portion for supplying ink to the ball point pen tip;

a protective cap adapted for securement over the ball point pen tip of the finger portion to prevent ink from dispelling out of the ball point pen tip;

a flexible adapter ring having an open first end, an open second end, and an intermediate extent therebetween, the intermediate extent having a slot formed therein extending from the open first end to the open second end thereby allowing the adapter ring to be positionable at any point of a user's finger, the flexible adapter ring removably securing to a user's finger to provide a tighter fit when the finger portion is secured on the user's finger.

* * * * *